United States Patent [19]

Jarreby

[11] Patent Number: 4,582,128

[45] Date of Patent: Apr. 15, 1986

[54] ROTATING HEAT EXCHANGER

[75] Inventor: Karl A. B. Jarreby, Falkenberg, Sweden

[73] Assignee: Skandinaviska Apparatindustri AB, Sweden

[21] Appl. No.: 641,941

[22] PCT Filed: Dec. 20, 1983

[86] PCT No.: PCT/SE83/00465

§ 371 Date: Aug. 8, 1984

§ 102(e) Date: Aug. 8, 1984

[87] PCT Pub. No.: WO84/02573

PCT Pub. Date: Jul. 5, 1984

[30] Foreign Application Priority Data

Dec. 20, 1982 [SE] Sweden ..... 8207251

[51] Int. Cl.[4] ..... F28D 11/02

[52] U.S. Cl. ..... 165/90; 122/26; 126/247

[58] Field of Search ..... 165/89, 90; 126/247; 122/26

[56] References Cited

U.S. PATENT DOCUMENTS

| | | | |
|---|---|---|---|
| 2,875,985 | 3/1959 | Hold | 165/89 |
| 2,899,176 | 8/1959 | Francis et al. | 165/90 X |
| 3,794,118 | 2/1974 | Bauch | 165/90 |
| 3,802,495 | 4/1974 | Hordis | 165/89 |
| 4,252,184 | 2/1981 | Appel | 165/90 |
| 4,261,112 | 4/1981 | Apitz | 165/90 |
| 4,454,861 | 6/1984 | Grenier | 126/247 |

FOREIGN PATENT DOCUMENTS

| | | |
|---|---|---|
| 0022156 | 1/1981 | European Pat. Off. . |
| 1947768 | 6/1971 | Fed. Rep. of Germany . |
| 2008994 | 9/1971 | Fed. Rep. of Germany . |
| 2431069 | 1/1976 | Fed. Rep. of Germany . |
| 623921 | 6/1981 | Switzerland . |
| 1561941 | 3/1980 | United Kingdom . |

*Primary Examiner*—Sheldon J. Richter

*Attorney, Agent, or Firm*—Harness, Dickey & Pierce

[57] ABSTRACT

The invention concerns a rotating heat-exchanger comprising a cylinder having an inner jacket, and outer jacket and a section intermediate the jackets for the heat-exchanging medium. The heat-exchanger is particularly intended for use in paper-making machines and paper converting machines. The invention solves the problem in such cylinders or rollers of reducing the rotating mass. In accordance with the teachings of the invention this is made possible by rotating only the outer jacket whereas the inner jacket and the central shaft or equivalent means are stationary.

9 Claims, 4 Drawing Figures

ROTATING HEAT EXCHANGER

BACKGROUND OF THE INVENTION

The subject invention relates to a rotating heat exchanger in the form of a cylinder having double jackets, comprising a heat exchanger section for passage-through of the fluid serving as the heat exchanging medium in the space between the cylindrical outer and inner jackets.

Prior-art heat exchangers of the type defined above are constructed in such a manner that the entire cylinder rotates both when it is supported by a through shaft or—more frequently—by a pair of stub axles secured to the cylinder ends. This means that shafts and axle bearings must be dimensioned on the basis of the total weight of the cylinder. Cylinders of this kind are used for instance in machines for production and drying of paper and in machines of this and similar nature the cylinders may have a length of up to 7 meters, a diameter of 1.5 meters and a weight of approximately 5 tons. The considerable weight presents additional disadvantages which are more important than the one already mentioned, i.e. the necessity to use large-size axle bearings.

One such additional disadvantage is due to the necessity of supplying and leading off the heat-exchanging medium via rotating seals. The latter must be replaced or repaired comparatively frequently due to considerable damages caused to them from wear, as a rule of impurities present in the heat-exchanging medium which in the case of papermaking machines generally consists of water or steam. Replacements mean operational standstills and in addition are costly in themselves, since packing boxes designed for rotating axles are expensive.

A third disadvantage connected with the considerable weight of the cylinder is the following one. The external face of the outer jacket must have a very smooth surface finish, particularly when the cylinder is used in calender rolling mills and in similar applications. When used in mills of this kind also comparatively minor scratches in the surface might make the cylinder unfit for use. When damages like these occur, the cylinder must be lifted off the machine with the aid of an overhead crane and the entire cylinder unit be transported to a workshop to be repaired. While the cylinder unit is being repaired a complete spare cylinder unit must be used.

A further disadvantage connected with the great cylinder weight is the correspondingly great inertial mass, which often makes it impossible to use the paper web or equivalent means to drive the cylinders. Instead, the latter must be driven by motor and the drive motors require complicated synchronization mechanisms which are sensitive to disturbances and which usually are thyristor-controlled.

The invention is based on the realization that it is possible to eliminate the above-mentioned disadvantages by constructing the cylinder in such a manner that only its outer jacket rotates while the inner jacket and the rest of the cylinder unit components are stationary. By constructing the cylinder in this manner several important advantages are obtained. Firstly, reduction of the mass of the movable components is considerable, allowing use of smaller and less expensive bearings. Secondly, elimination of the rotating sealing members, because the cylinder comprises stationary parts through which the medium may be supplied and removed. Thirdly, when damages are made to the outer jacket the latter may be conveniently and readily dismantled from the cylinder, while all other components remain in position, which drastically reduces the handling and actual repair costs. Fourthly, the rotating mass is so small that as a rule the web itself will be capable of driving the cylinder jacker, whereby the need for drive motors for several cylinders and synchronizing means therefor become superfluous.

The arrangement in accordance with the invention gives additional advantages which will be described in the following. However, one should be mentioned already at this point. Because the heat-exchanging medium passes through a space inside the cylinder, one of the large delimiting walls of which, the inner jacket, is stationary while the other large delimiting wall, the outer jacket, is rotating a relative movement is generated in the peripheral direction between the medium and the outer jacket. The practical consequence of this phenomenon is that the heat exchange no longer is effected exclusively by conduction but is supplemented to a large extent by convection.

A pronounced turbulent flow of the heat-exchanging medium is generated, resulting in excellent exchange of heat between the medium and the outer jacket.

SUMMARY OF THE INVENTION

The heat exchanger in accordance with the invention is characterized in that the inner stationary jacket is formed along its external face with one or several helically extending ribs designed to guide the heat-exchanging medium in a helical flow path through the heat-exchanging section and thus imparting to the latter a component of velocity in the peripheral direction of the cylinder, that the outer jacket is arranged to rotate relative to the inner jacket in a direction counter to the peripheral component of velocity of the heat-exchanging medium in order to generate a turbulent flow of the heat-exchanging medium through the heat exchanging section, and that stationary channels are arranged to conduct the heat-exchanging medium to and from the heat exchanging section.

BRIEF DESCRIPTION OF THE DRAWINGS

The invention will be described in closer detail in the following with reference to the accompanying drawings, wherein FIGS. 1–3 illustrate one end wall of the cylinder but the opposite wall is of identical design and construction with the exception that no drive means are provided at this end.

DETAILED DESCRIPTION OF PREFERRED EMBODIMENTS

Figure 1:
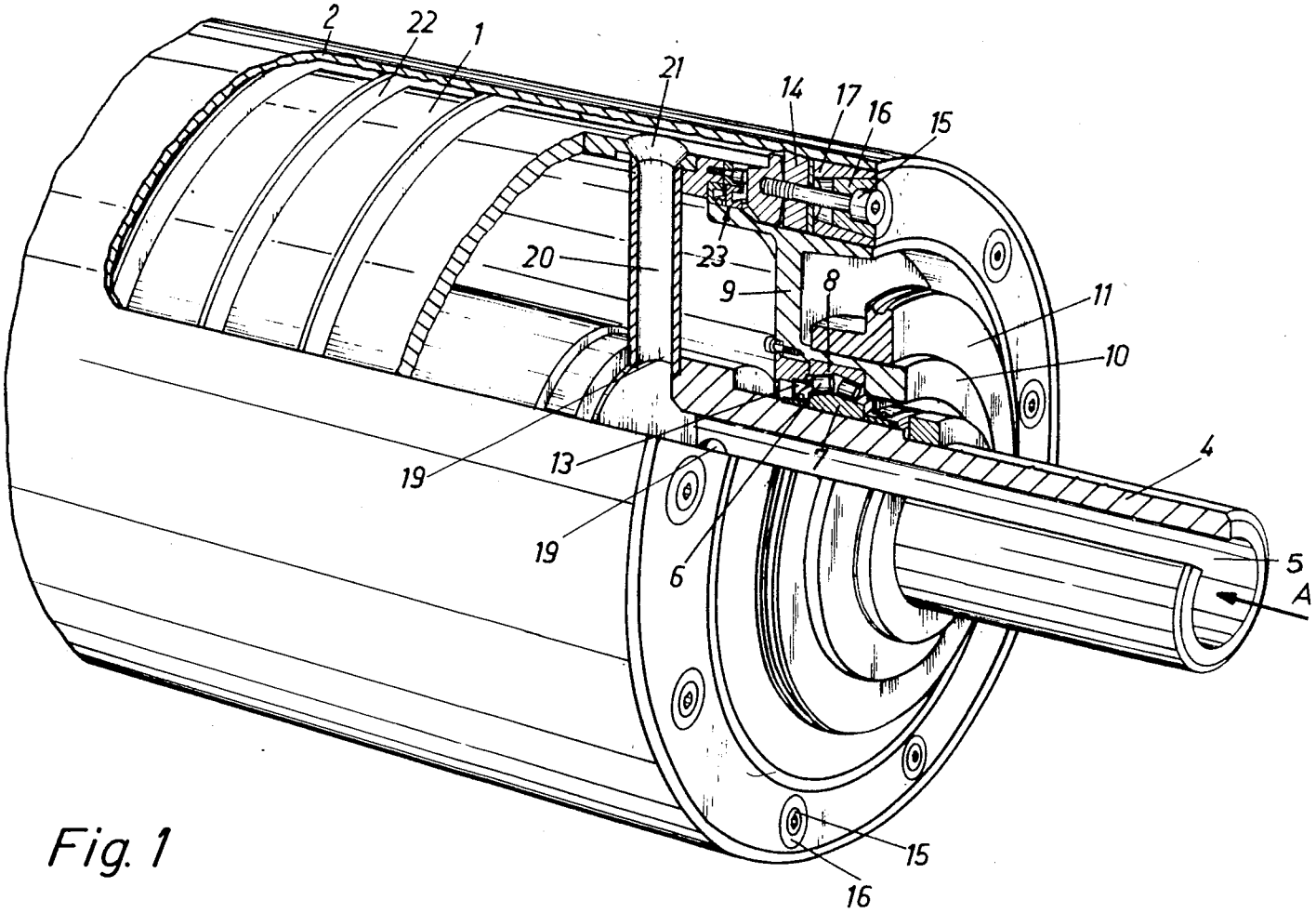
FIG. 1 is a partly broken perspective view of one end of a rotating heat exchanger in accordance with the subject invention.

As mentioned in the afore-going the heat exchanger in accordance with the invention is of the type consisting of a cylinder comprising an inner jacket 1 and an outer jacket 2 with a section 3 between the jackets for a heat-exchanging medium, such as water or steam. By means of suitable, not illustrated conduit means the medium is supplied to the cylinder, e.g. by pumping, at the point illustrated by arrow A where the medium flows into a stationary shaft 4 supporting the inner jacket 1. The shaft 4 is tubular, defining an axial passageway 5 inside the shaft.

On the shaft 4 is mounted a spherical roller bearing 6 its inner carrier ring 7 being shrunk onto the shaft 4. The outer carrier ring 8 of the roller bearing supports an end-wall closing lid 9 which supports a tubular section 10. A driven wheel 11 is mounted on the tubular section 10 and may be secured thereto in any suitable manner, such as by means of bolts. A smaller lid 12 surrounding the shaft 4 is attached to end-wall lid 9 internally of the roller bearing 6. Seals 13 are provided between the lid 12 and the shaft 3. The end-wall lid 9 and the lid 12 consequently are rotationally mounted relative to the stationary shaft 4.

Radially externally of the end-wall lid 9 is a retainer ring 14 which is provided with a plurality of axially extending, threaded bores which engage the threads of screws 15. In accordance with the embodiment illustrated in the drawings, these are formed with heads of Allen-screw type, which are countersunk in apertures in a double-cone clamping ring 16 which upon tightening of the screws cooperates in a wedging-effect fashion with a conical ring 17. When the screws 15 are tightened the ring 17 is forced radially outwards and in doing so retains the outer jacket 2 in position.

From the passageway 5 in the interior of the shaft 4 the heat-exchanging medium is conducted through a number of openings 19 formed in the shaft wall into essentially radially extending, stationary channels 20 which are supported by the shaft 4 and are formed at their opposite ends with outlet mouths 21, the latter being positioned in a radial plane in relation to shaft 4. The heat-exchanging medium flows through the passageway 5, the openings 19, the channels 20 and the outlet mouths 21 to the section 3 formed between the jackets 1 and 2. The inner jacket 1 is formed with a helically extending rib 22 which forces the medium to flow in a helical path from one end of the cylinder to the other instead of assuming an axial flow path. In this manner the medium is imparted a motion which possesses a considerable component of velocity in the peripheral direction of the cylinder. The rib 22 exerts a vane-like effect on the medium flow and thus contributes to generating turbulence in the flow. It is possible to provide more than one rib 22 in which case the ribs are arranged in a manner corresponding to the threads of multiple thread screws. It may be advisable to form conduits for the medium in this manner in which case each conduit starts at the mouth 21 of a channel 20.

The section 3 is limited at its ends by the annular seal 14 and by a seal 23 disposed between the rotatably mounted end-wall lid 9 and the inner stationary jacket 1. The seal 23 is formed by a sealing member 24 which is retained in position by means of a screw 25 which is screwed into the inner jacket 1 and retains a locking ring 26, the latter in turn exerting a retaining clamping action on the sealing members 24 in conjunction with a ring 27. In this manner the seal 23 will be positioned close to the periphery of the cylinder to prevent the heat-exchanging medium from penetrating into the cylinder interior.

Figure 3:
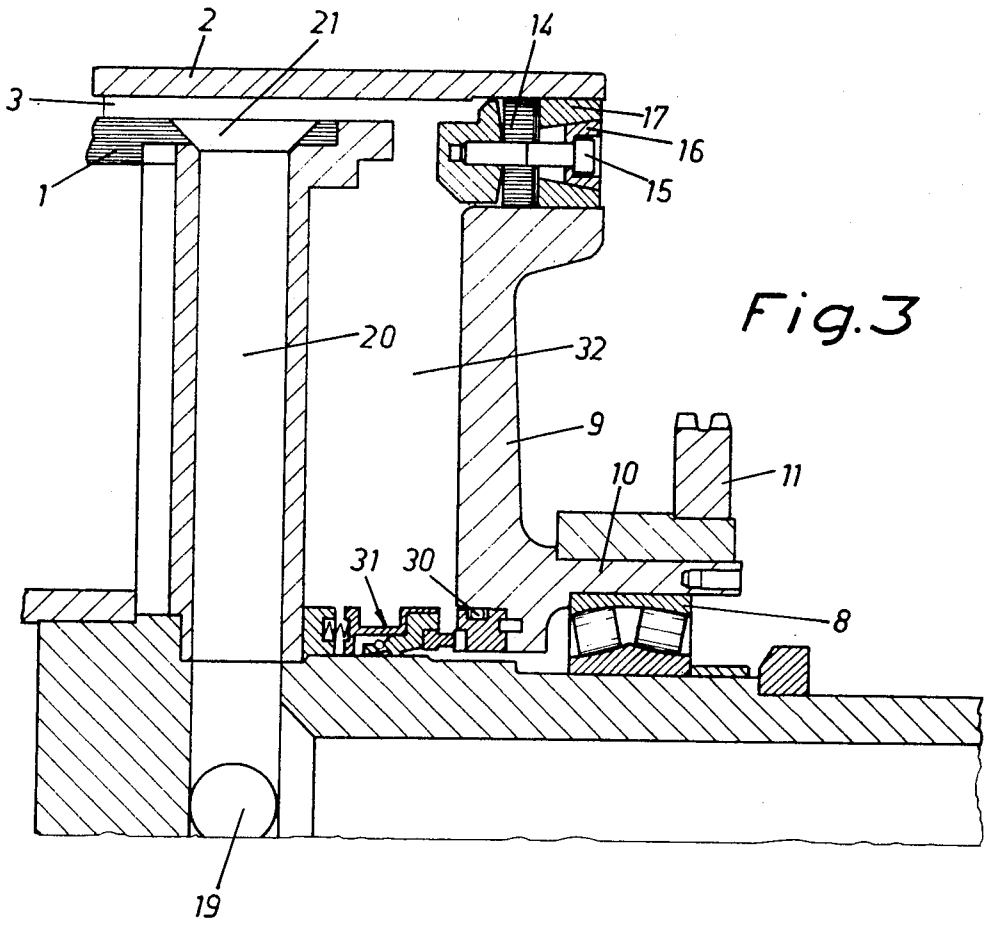
FIG. 3 is a cross-sectional view corresponding to FIG. 2 of a modified embodiment of the invention.

FIG. 3 shows a somewhat different embodiment of the invention. The seals 23 at the ends of the section 3 have been eliminated and been replaced by seals 30 positioned in the area where the end wall 9 is mounted on the shaft 4. The seals 30 are retained in position by means of spacer elements 31 which are arranged on the shaft 4. In accordance with the embodiment shown in this drawing figure the medium has access to the space 32 internally of the end wall 9. The seal 30 will be exposed to less velocity and frictional stress than the seal 23.

As appears from the drawings and the aforegoing it is only the comparatively thin outer jacket 2 and the end-wall lids 9 supporting the jacket that are rotatably mounted whereas the rest of the entire cylinder unit, above all the shaft 4 and the inner jacket 1, are stationary. This principle of construction means that the drawbacks mentioned initially with respect to prior-art rotating heat exchangers of the type comtemplated herein have been eliminated as has been described above. When the medium is steam it may be conducted from the cylinder into a condensor in which it is condensed to recover the heat generated when steam is formed. In many cases it may be suitable to position adjustable turbine blades (not shown) at the entrance to the section 3.

In prior-art rotating heat exchangers, constructed as cylindrical rollers all of which is rotational, the guide ribs 22 may abut against the inner face of the outer jacket. In rollers constructed in accordance with the invention in which the inner jacket 1 and the outer jacket 2 may move relative one another it is obviously no possible to arrange the guide ribs in abutment against the outer jacket. Instead it is necessary to provide for some radial play between the ribs 22 and the outer jacket 2. In principle, this could be achieved by two principally different methods, or by a combination of the two. The first principle resides in dimensioning the outer jacket wall sufficiently to prevent that the latter is deformed radially inwards by a reverse roller during operation with consequential loss of the play. In practice, this means that the material thickness of the outer jacket must be between 12 and 20 mm. The second method is to construct the outer jacket with a thin wall, which gives improved heat transfer and as a result the heat-exchanging medium generates the required forces of reaction. This is achieved by subjecting the medium to a static overpressure effected for instance by throttling on the medium exit side. When the outer jacket supports one or two turbine-blade supporting rings these actively contribute to stiffening the jacket radially.

It should also be noted that the outer jacket need not be positively driven but on the contrary one of the advantages of the subject invention is that owing to the greatly reduced material mass the outer jacket may also be driven by the web travelling between the jacket and its reverse roller, for instance in a papermaking machine. This means that not only does the need for driving mechanisms become superfluous but that the same is true as regards the otherwise necessary synchronization mechanisms.

In prior-art heat exchanger rollers constructed with an inner jacket and an outer jacket which rotate together, the heat-exchanging medium is imparted essentially the same peripheral velocity as the roller. The insignificant difference that does exist depends wholly on the flow resistance. This means that the heat transfer that takes place between the medium and the outer jacket occurs exclusively through conduction. In a heat-exchanger roller in accordance with the invention the medium has no component of velocity at all in the peripheral direction upon its entrance into the space 3 (or, in the case turbine blades are used, only a negligible component of this kind). Without the provision of the ribs 22 the medium, in principle not rotating, would have flowed axially from one end of the roller to the opposite one. Since the outer jacket rotates a relative motion in the peripheral direction is created between the medium and the outer jacket. The result of this difference in velocity is a turbulent flow which is genererated in the heat exchanging medium and that the exchange of heat will occur not only by conduction but also through convection. This effect is further hightened by orientating the ribs 22 in such a manner that the peripheral component of the medium flow velocity around the inner jacket 1 is counter to the rotational speed of the outer jacket 2, i.e. the total difference in velocity between the medium and the outer jacket equals the sum of these two velocities.

Figure 2:
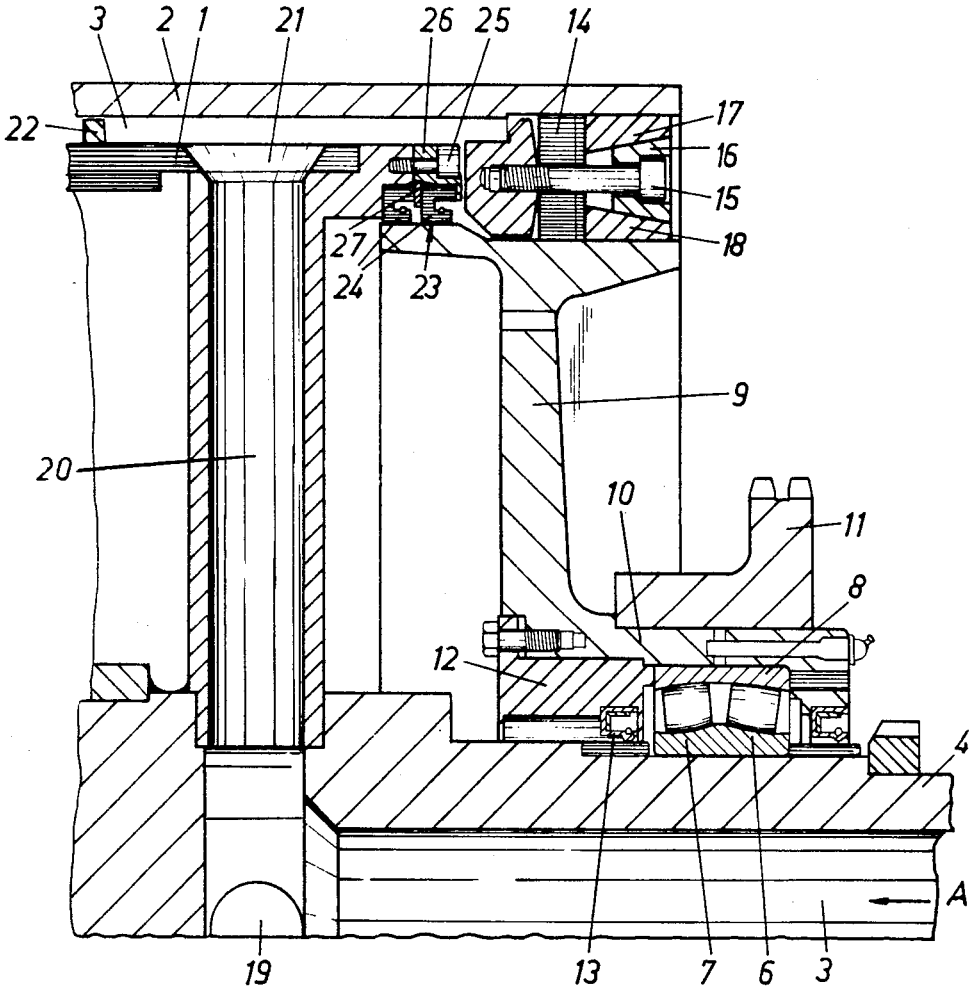
FIG. 2 is a cross-sectional view through a detail of the heat-exchanger in accordance with FIG. 1.
Figure 4:
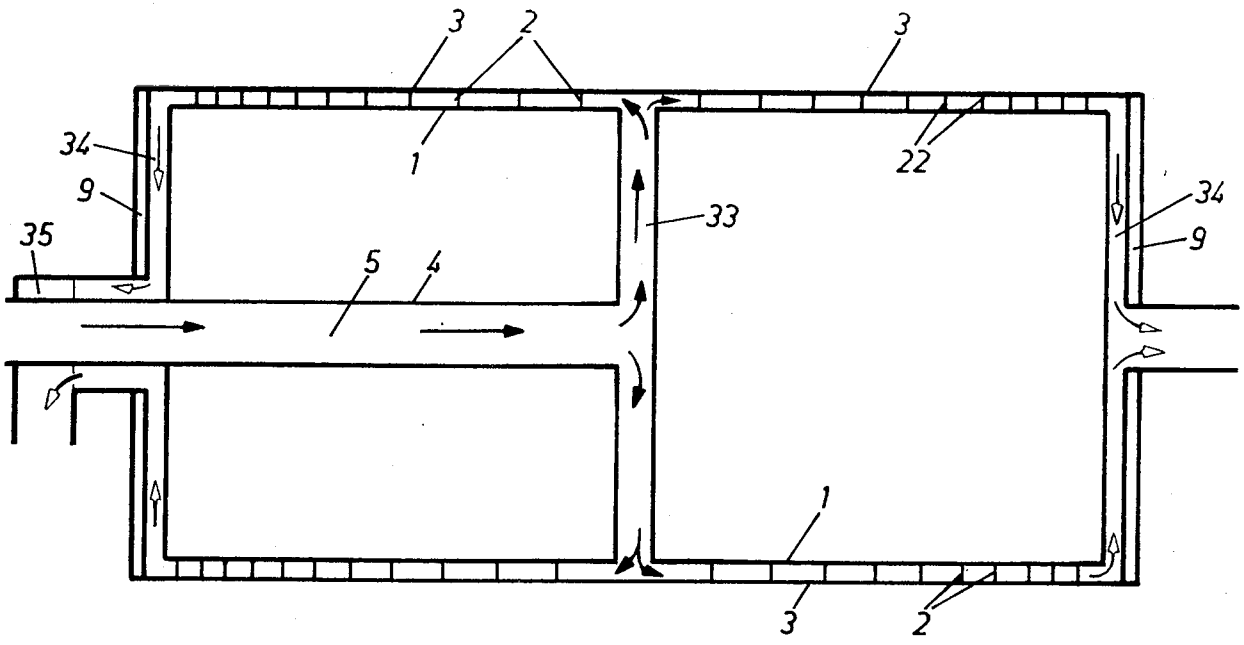
FIG. 4 is a schematic overall view of a further embodiment of the invention.

FIG. 4 shows schematically another possible embodiment of the invention. The heat exchanger in accordance with this embodiment of the invention comprises stationary channels 33 at the centre of the heat exchanger, these channels 33 being designed in the same manner as channels 20 to lead the medium from the axial passageway 5 in the shaft 4 to the heat-exchanging section 3 formed between the inner and outer jackets 1, 2. From the outlet of the channels 33 the medium will divide into two flows, flowing in opposite directions into the heat-exchanging section 3. Preferably, ribs 22 are positioned in such a manner that both medium flows will be imparted a component of velocity in the same direction in the peripheral direction in the jacket 2. This makes it possible to rotate the outer jacket 2 counter to this component of velocity of the medium. In accordance with this embodiment of the invention stationary channels 34 are provided at the two end walls 9 of the heat exchanger to carry away the medium from the gap 3. Medium may be carried to the channels 33, as shown in FIG. 4, through the passageway 5. An annular channel 35 preferably is provided about the shaft 4 to carry away the medium from one of the end walls of the heat exchanger. At the opposite end wall the medium is led off in the conventional manner. It is likewise possible to arrange for the supply flow of heat-exchanging medium through a separate central tube which is positioned inside the passageway 5 and is provided with radial spokes connecting it to the channels 33. In accordance with this embodiment the annular channel 35 becomes superfluous since medium may be led off through the passageway 5. The embodiment of the invention shown in FIG. 4 has the advantage over those shown in FIGS. 1–3 that the two end walls of the heat exchanger are exposed to equal pressure form the heat-exchanging medium.

Preferably, the temperature on the external face of the outer jacket 2 should be equal at both ends of this jacket and preferably it should be uniform throughout the entire length of the jacket. This could be achieved for instance by forming the channel delimited by the rib 22 in a tapering fashion in its lengthwise extension, with the result that the velocity of the heat-exchanging medium increases and that it becomes possible to control it in such a manner that the external temperature of the outer jacket 2 remains constant, despite the gradual cooling of the heat-exchanging medium. In the Swedish Patent Specification No. 367 666 are described both this method of controlling the external temperature of the outer jacket 2 and other ways of achieving the same effect which may be used together with the subject invention.

Finally should be emphasized that in the practical applications of the subject invention it is possible to deviate from the constructional and functional designs which by way of examples have been illustrated in the drawings. The medium may be a liquid, generally water, steam, or a gas. It could be also a two-phase medium.

The number of channels 20, 33 may be chosen according to need. Also, they could be constructed with a changing cross-section, for instance such that they are comparatively wide in the area of the outlet mouths 21 in the peripheral direction but narrow in the axial direction but at their inlets 19 essentially square or round.

A heat exchanger roller in accordance with the invention may be used in a variety of applications. At present, the most important one is considered to be in papermaking machines. Other applications are in paper-converting machines, for example in laminating or impregnating paper and in printing and textile machines. The invention is also applicable in rollers and calanders in the plastics and rubber industries, in the food-producing industry and in the pharmaceutical industry. As an example of use in the food-production industry could be mentioned the type of roller used in the confectionary industry for the production of pralines. Rollers for this purpose are formed with recesses on their external face. Soft chocolate is poured to successively fill into the recesses which at every instant are positioned on the upper face of the rotating roller. After rotation of the roller over half a turn the chocolate must be set, allowing the finished pralines to fall downwards by gravity. This is one example of many of an area where efficient exchange of heat between the outer jacket and the medium, in this case a cooling medium, is desired.

When the invention is applied to particularly papermaking machines it is, as mentioned above, often possible to eliminate separate roller driving and syncronizing mechanisms thanks to the decreased rotating mass and instead the paper web or corresponding means is allowed to drive the roller. When a web has not yet formed, which is the case when the sheet is being threaded through the machine, the rollers must, however, be driven in some other way. In this case it is an advantage to use turbine blades. When the blades are adjustable their angle of incidence may be set to ensure that the rotational speed imparted by the turbine in the outer jacket is somewhat less the speed corresponding to the peripheral speed of the web. In this manner protection is obtained against occurrence of undesirable tensile stresses in the web, also without the use of synchronizing mechanisms. Alternatively, after completion of the sheet-threading it is possible to set the blades to a zero angle of incidence.

What I claim is:

1. A rotating heat exchanger in the form of a cylinder having inner and outer spaced apart jackets defining a heat exchanger section for passage of a fluid serving as the heat-exchanging medium in the space between the outer jacket and the inner jacket, said inner jacket being stationary, and means for rotating said outer jacket relative to said inner jacket in a first circumferential direction, characterised in that one of said jackets is formed along its face exposed in said heat-exchanger section with at least one helically extending rib designed to guide the heat-exchanging medium in a helical flow path of a predetermined hand through said heat-exchanger section and thus imparting to the medium a component of velocity in the peripheral direction of the cylinder counter to the direction of rotation of said outer jacket in order to generate a turbulent flow of the heat-exchanging medium through said heat exchanging section.

2. A rotating heat exchanger according to claim 1, characterized in that stationary channels for conducting heat-exchanging medium to the heat exchanging section are positioned at the centre of the cylinder, and in that channels for conducting heat-exchanging medium from the heat exchanging section are positioned at the cylinder end walls, there being at least one helical rib extending from the centre of said cylinder to a respective one of the end walls.

3. A rotating heat exchanger according to claim 1, characterised in that stationary channels for conducting heat-exchanging medium to and from the heat-exchanging section are positioned at the end walls of the cylinder.

4. A rotating heat exchanger in accordance with claim 1, characterised in that the inner jacket is non-rotationally mounted on a shaft, that said shaft is provided with an internal passageway, and further including stationary radial channels in the cylinder communicating said passageway to the heat-exchanging section between the two jackets.

5. A rotating heat exchanger according to claim 4, characterised in that stationary channels for conducting heat-exchanging medium to the heat exchanging section are positioned at the centre of the cylinder, and in that channels for conducting heat-exchanging medium from the heat exchanging section are positioned at the cylinder end walls, there being at least one helical rib extending from the centre of said cylinder to a respective one of the end walls.

6. A rotating heat exchanger according to claim 4, characterised in that stationary channels for conducting heat-exchanging medium to and from the heat-exchanging section are positioned at the end walls of the cylinder.

7. A rotating heat exchanger as claimed in claim 4, characterised in that the outer jacket is rotatably mounted on the shaft and that the jacket mounting means is a rotatably mounted end-wall lid provided at the end parts of the cylinder.

8. A rotating heat exchanger according to claim 7, characterised in that stationary channels for conducting heat-exchanging medium to the heat exchanging section are positioned at the centre of the cylinder, and in that channels for conducting heat-exchanging medium from the heat exchanging section are positioned at the cylinder end walls, there being at least one helical rib extending from the centre of said cylinder to a respective one of the end walls.

9. A rotating heat exchanger according to claim 7, characterised in that stationary channels for conducting heat-exchanging medium to and from the heat-exchanging section are positioned at the end walls of the cylinder.

* * * * *